US005544568A

United States Patent [19]

Potgieter

[11] Patent Number: 5,544,568

[45] Date of Patent: Aug. 13, 1996

[54] COOKWARE

[76] Inventor: Jacobus L. Potgieter, P.O. Box 334, Steenberg 7945, South Africa

[21] Appl. No.: 541,907

[22] Filed: Oct. 10, 1995

[30] Foreign Application Priority Data

Oct. 12, 1994 [ZA] South Africa ..... 94/7968

[51] Int. Cl.[6] ..... A47J 27/00; A47J 36/00; A45C 11/20; B65D 81/38

[52] U.S. Cl. ..... 99/340; 99/403; 220/408; 220/420; 220/425; 220/739; 220/903; 220/912

[58] Field of Search ..... 99/337–339, 340, 99/357, 403, 407, 410–418, 467; 126/369, 373, 375–377, 390; 206/541, 544–546, 549; 220/400, 408, 411–413, 420–426, 375, 428, 431, 522, 739, 737, 902, 903

[56] References Cited

U.S. PATENT DOCUMENTS

| | | | |
|---|---|---|---|
| 472,002 | 3/1892 | Ross et al. | 99/340 |
| 1,331,530 | 2/1920 | Shaw | 99/403 |
| 1,625,999 | 4/1927 | Irish | 99/403 |
| 1,998,920 | 4/1935 | Bremer | 99/340 |
| 3,355,045 | 11/1967 | Douglas | 220/425 |
| 3,670,918 | 6/1972 | Mitchell | 206/545 |
| 4,675,508 | 6/1987 | Miyaji et al. | 220/420 |
| 4,721,216 | 1/1988 | Kinder | 220/903 |
| 4,921,120 | 5/1990 | Mizioch | 220/739 |
| 5,031,519 | 7/1991 | Toida et al. | 99/340 |
| 5,251,542 | 10/1993 | Itoh et al. | 99/403 |
| 5,335,809 | 8/1994 | Toida et al. | 220/375 |
| 5,355,777 | 10/1994 | Chen et al. | 99/340 |

*Primary Examiner*—Timothy F. Simone
*Attorney, Agent, or Firm*—Ladas & Parry

[57] ABSTRACT

An outer container (24) which comprises a base part (26) and a cover part (34), both of foamed synthetic plastics material, receiving a metal cooking pot (10) including a lid (14). The container forms a jacket which limits heat losses from the pot after it has been removed from the source of heat. The lower edge surface (38) of the upper part (34) rests on a surface (32) of the lower part (26). A spigot (36) of the lower part (26) locates the upper part (34).

10 Claims, 4 Drawing Sheets

COOKWARE

FIELD OF THE INVENTION

This invention relates to cookware.

BACKGROUND TO THE INVENTION

Cooking in a pot on an open hot plate is inefficient in terms of the energy used because of heat losses. Very little can be done during cooking but it is possible to place the pot into an outer container, or to wrap it in an insulating material such as a towel, after cooking thereby to prevent the temperature dropping too rapidly.

OBJECTS OF THE INVENTION

The main object of the present invention is to provide efficient means for minimising heat losses from a hot cooking pot once it has been removed from the source of heat.

A further object of the present invention is to provide a heat retaining insulated container for receiving a hot cooking pot and from which condensed water vapour is discharged with minimum heat loss.

Another object of the present invention is to provide a heat retaining insulated container which is protected from damage when a hot cooking pot is placed therein.

BRIEF DESCRIPTION OF THE INVENTION

According to the present invention there is provided, in combination, a cooking pot which is circular in plan view and which has a Lid, and a heat insulating container for receiving the pot, the container being of foamed synthetic plastics material and including an upwardly open base part having a side wall and base wall and into which said pot with its lid thereon can be lowered until it is supported by a top surface of said base wall, and a downwardly open cover part which includes a top wall and a side wall depending from the top wall, the cover part fitting onto said base part and defining therewith a cavity within which the pot is enclosed, the internal diameter of the container being greater than the external diameter of the pot whereby there is a heat insulating air gap between the pot and inner faces of said side walls.

To enable the lid to be removed from the pot it can have a knob protruding from the top surface thereof, and the underside of said top wall can have a recess therein for receiving said knob.

To ensure that said parts fit together properly, said side wall of said base part can include a surface on which said side wall of the cover part is supported whilst the container is in its closed condition, and said base part can further include a spigot which is radially inwardly of said support surface and which protrudes into said cover part.

In one form said top surface of said base wall has a central depression therein, said depression being encircled by a rim which supports the pot. Preferably the diameter of the inner cylindrical surface of said lower part tapers and is at its smallest adjacent said rim, said pot including a change in external diameter in the region of a base thereof thereby to provide a rim which engages said inner cylindrical surface and centers the pot in said base part.

Because polystyrene, the preferred material for the container, can be damaged by a pot the temperature of which is that of boiling water, there can be heat insulating means for preventing direct contact between the pot and said foamed plastics material of the container.

Said heat insulating means can comprise a coating of vermiculite on said base part or a plurality of tiles.

The external diameter of said side wall of the base part is preferably greatest where the base part is upwardly open, and the external diameter of said side wall of the cover part is preferably greatest where said cover part is downwardy open, the two greater diameter parts forming an external rib which extends around the container.

Because foamed synthetic plastics materials are not very resistant to scratching, a film of synthetic plastics material can be shrunk onto said cover part and onto said base part so as to cover the external surfaces thereof.

BRIEF DESCRIPTION OF THE DRAWINGS

For a better understanding of the present invention, and to show how the same may be carried into effect, reference will now be made, by way of example, to the accompanying drawings in which.

DETAILED DESCRIPTION OF THE INVENTION

Figure 1:
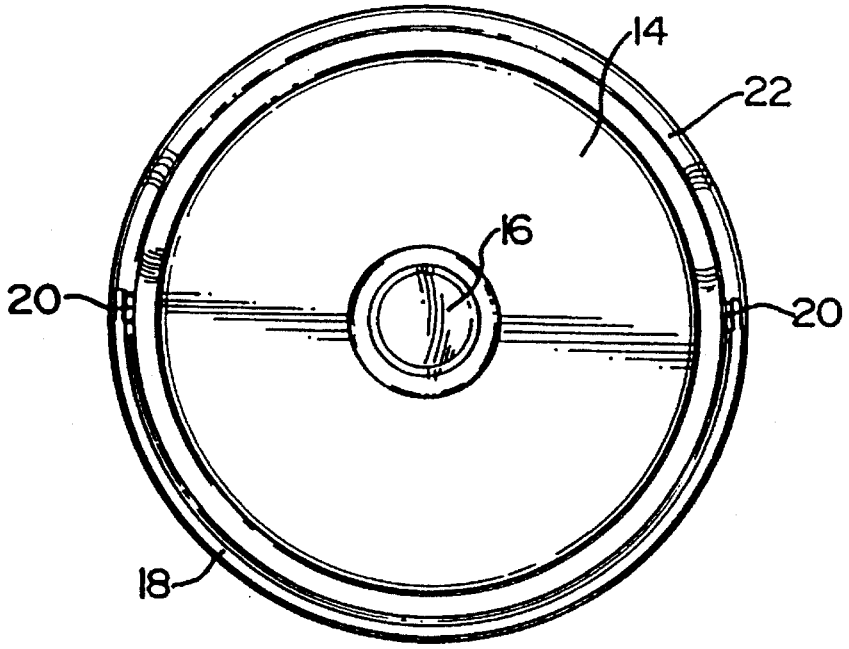
FIG. 1 is a top plan view of a pot with a lid.
Figure 2:
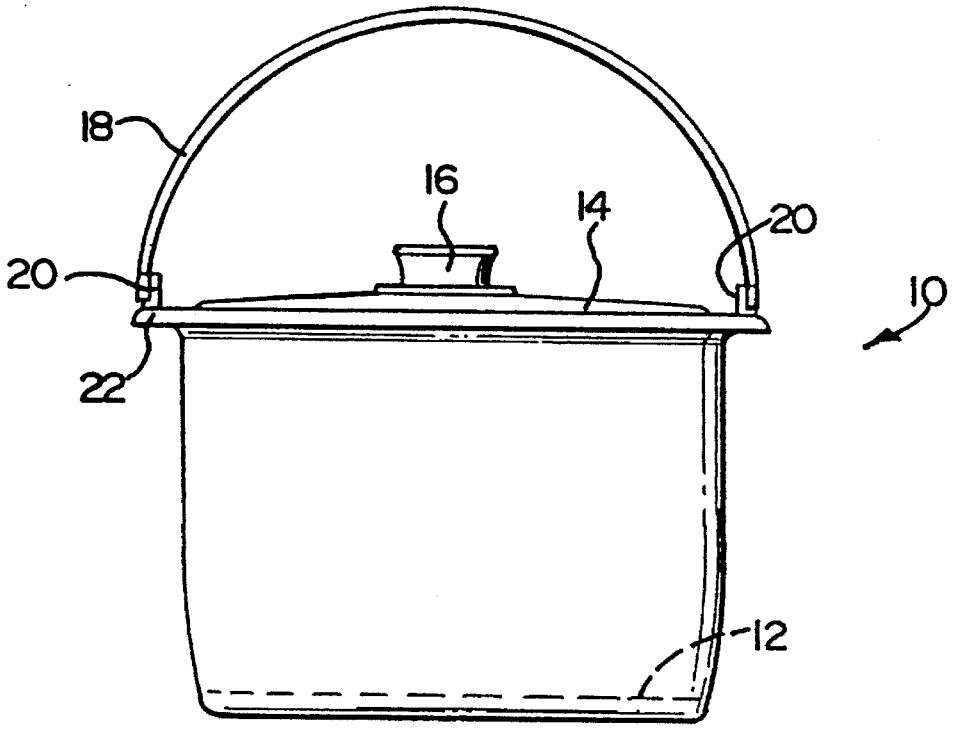
FIG. 2 is a side elevation showing the pot with its handle raised.
Figure 3:
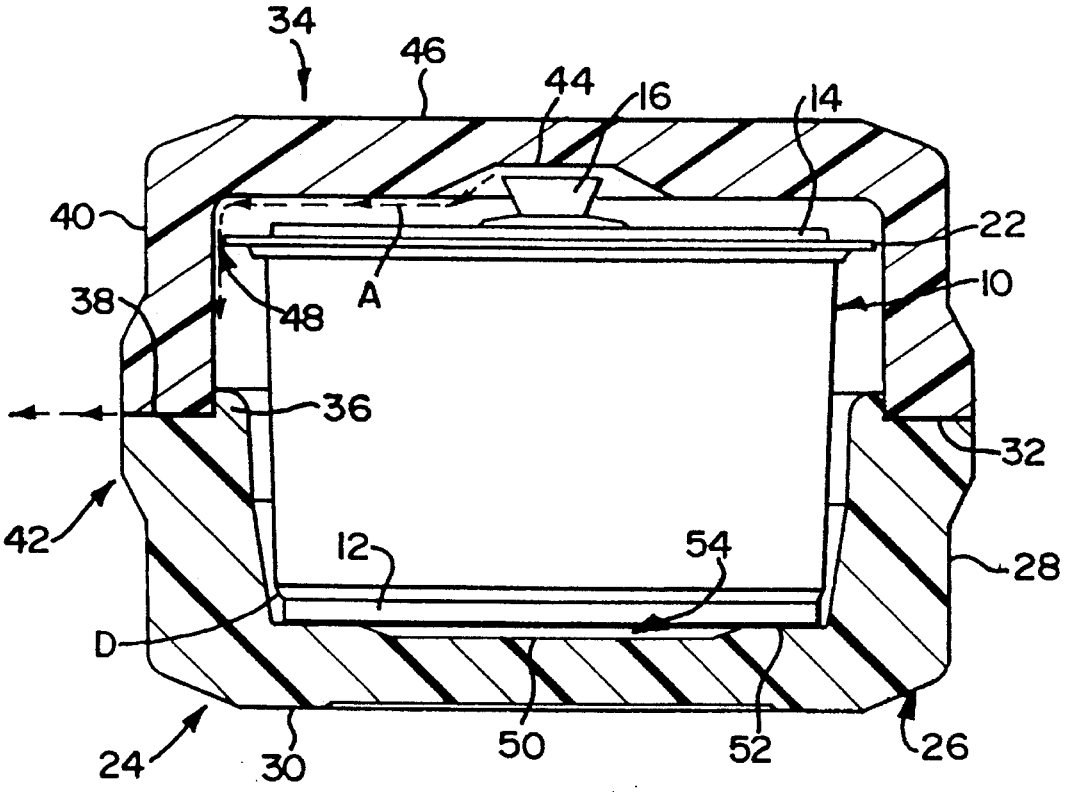
FIG. 3 is a section showing a pot in an insulated container.

The cooking pot shown in FIGS. 1, 2 and 3 is generally designated 10 and is of the type which has a thick aluminium base 12. The pot 10 includes a lid 14 with a knob 16 at the centre thereof so that the lid can be lifted off.

The pot 10 also has a handle. The handle of the pot is designated 18 and is in the form of a rod bent to the shape of a semi-circle. The rod is pivotally secured at both ends thereof to lugs 20 which are themselves attached to a flange 22 which extends around the mouth of the pot 10. Preferably the lugs 20 pass through the flange 22 and are threaded at their lower ends. Nuts of circular rather than hexagonal shape are screwed onto the parts of the lugs 20 below the flange 22.

It will be understood from FIGS. 1 and 2 that the handle 18 can pivot with respect to the pot 10 between an inoperative position (shown in FIG. 1) in which it lies in a diametral plane of the pot 10. In its inoperative condition the handle 18 lies substantially horizontally and rests on the flange 22. As will clearly be seen from FIG. 1, the dimensions of the handle 18 and flange 22 are such that, when the handle 18 is substantially horizontal, it lies entirely within the area bounded by the flange 22.

Turning now to FIG. 3, this shows the pot 10 and its lid 14 within a two part heat retaining insulated container or jacket 24. The container 24 comprises a base part 26 which is cylindrical and includes a side wall 28 and a base wall 30. The top edge of the side wall 28 is stepped to provide a support surface 32 for a cover part 34 of the container 24. The step also provides a locating spigot 36.

The cover part 34 is of generally the same shape as the base part 26 but inverted with respect thereto. The surface 38 which constitutes the lower edge of the side wall 40 of the cover part is not stepped but rests on the surface 32 with the spigot 36 protruding into the part 34. The pot 10 rests on the upper surface of the base wall 30 and extends into the part 34. It will be noted that the pot is a close fit in the cylindrical space of circular cross section bounded by the container 24. More specifically, the flange 22 is close to the inner surface of the wall 40 of the part 34.

The parts 26 and 34 are preferably of expanded polystyrene.

Figure 4:
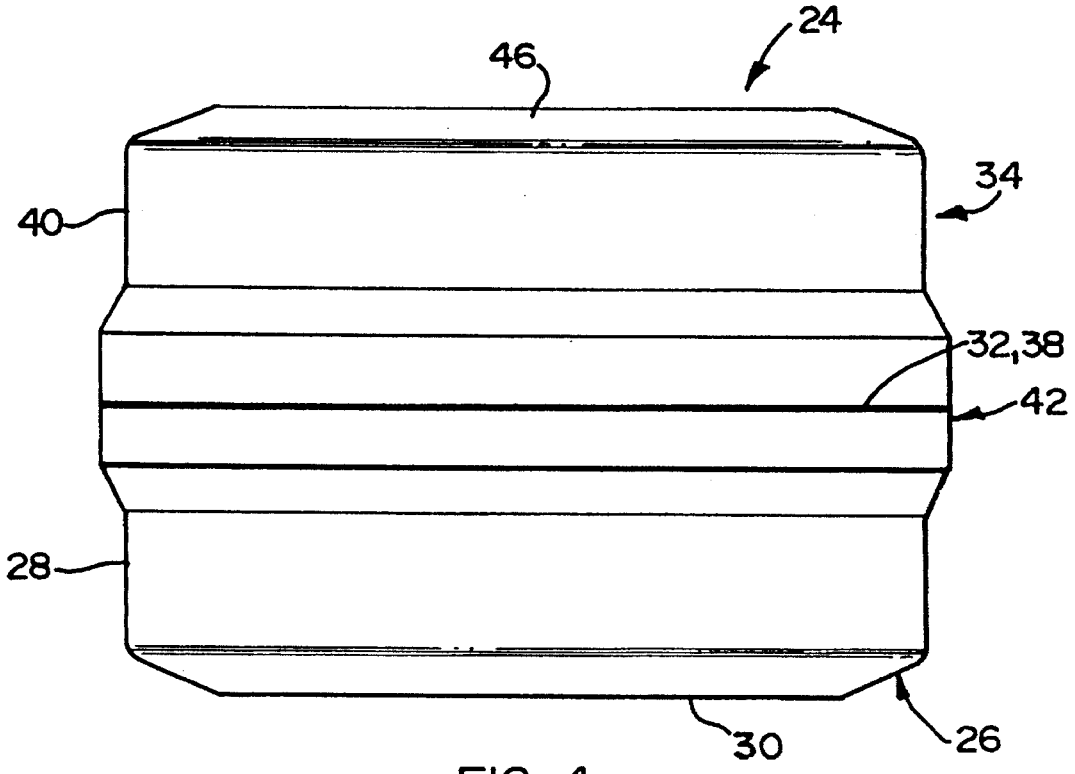
FIG. 4 is a side elevation of the insulated container.
Figure 5:
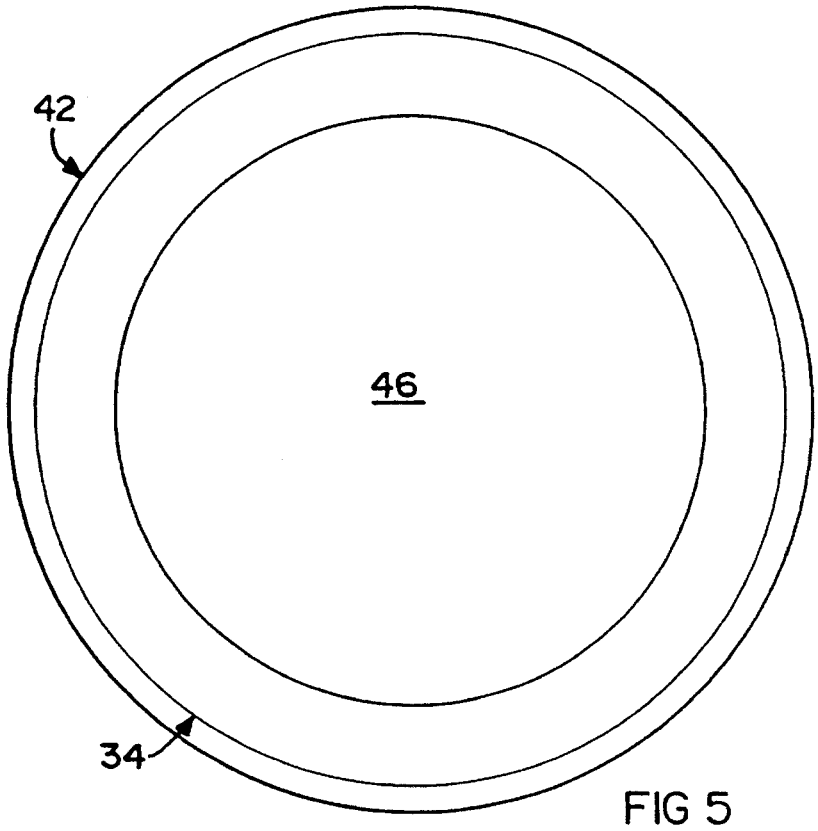
FIG. 5 is a top plan view of the insulated container.
Figure 6:
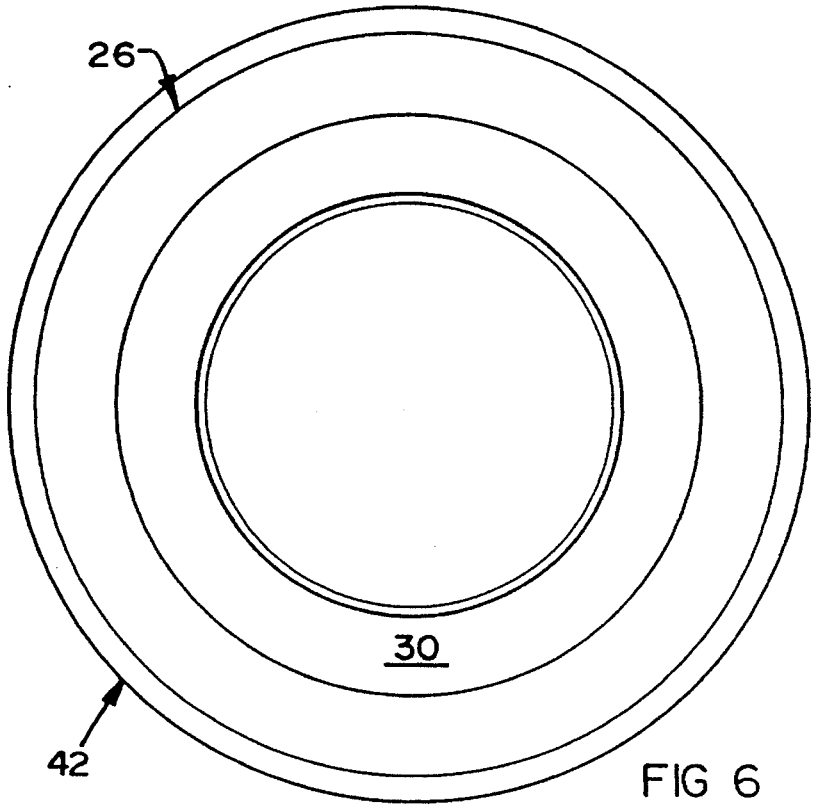
FIG. 6 is an underneath plan view of the insulated container.
Figure 7:
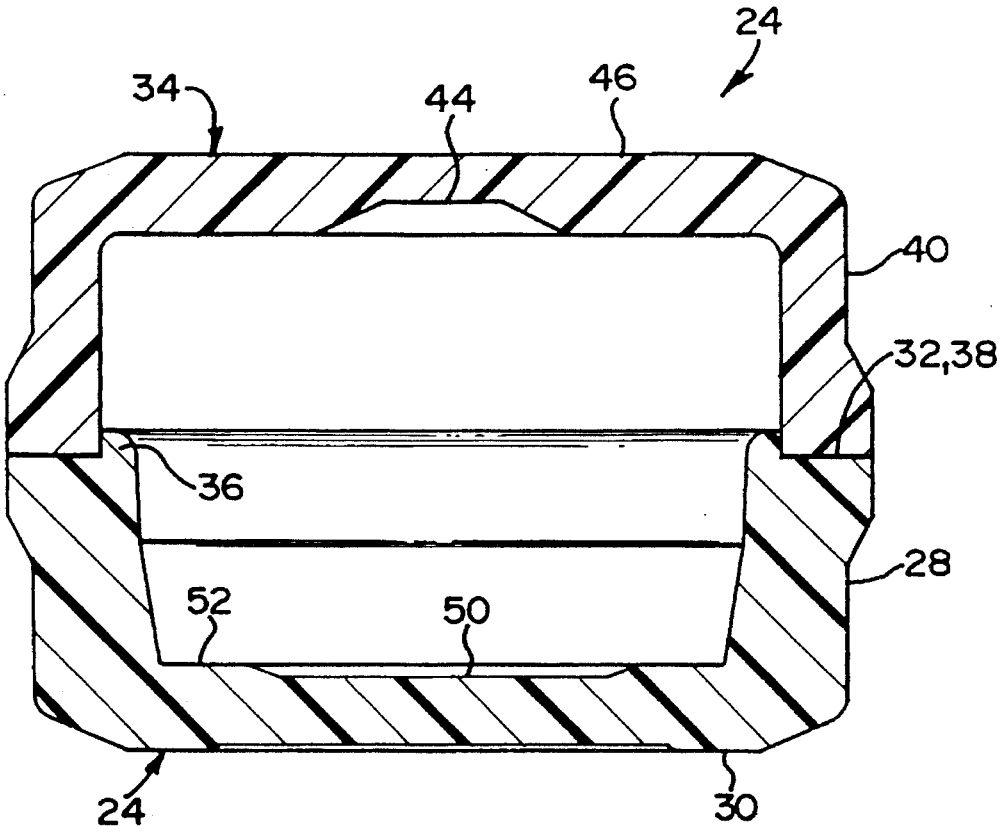
FIG. 7 is a section similar to FIG. 3 but omitting the pot.

Externally, the part 26 is of greater external diameter in the region of the support surface 32 than it is over the remainder of its extent. Likewise, the part 34 is of greater external diameter in the region of the surface 38 than it is elsewhere. This results in an external, circumferentially extending rib generally designated 42 mid-way between the top and bottom faces of the container (see particularly FIG. 4).

Internally the part 34 has a recess 44 in the underside of the top wall 46 thereof. This receives the knob 16. The flange 22 is, as stated, a close fit within the side wall 40 but does not touch the inner face of the side wall 40. There is consequently an air gap 48 around the flange 22 and around the pot over virtually the entire vertical extent of the pot. Moisture condensing on the underside of the top wall 46 flows along the path shown by the arrows A and emerges from the container between the upper and lower parts 26, 34. Heating of the air within the container when a hot pot is placed in results in slight lifting of the top part 24 with respect to the bottom part 26, and this promotes outflow of moisture. Water accumulation in the part 26 is thus avoided.

The base part 26 has an internal depression 50. The pot 10 rests on the rim 52 of the depression 50 whereby there is an insulating air gap 54 below the base 12 of the pot 10.

The lower part of the internal cylindrical face of the wall 28 and the top surface of the base wall 30 has a coating of a material such as vermiculite which forms a thermal barrier between the pot 10 and the container 24. Tiles or other forms of spacer, or another form of coating instead of vermiculite, can be used to prevent direct contact between the container 24 and the pot 10. Heat insulating spacers may be secured to the base 12 of the pot 10 if desired.

Expanded polystyrene is not a material which resists chipping and scratching very well and consequently the entire outer surface of each part 26, 34 can have a film of sheet synthetic plastics material vacuum formed onto it to form a protective skin. The plastics film can be of PVC, high impact polystyrene or ABS. Vacuum can be drawn through the parts 26 and 34, which are sufficiently porous for this purpose, so that the film is drawn tight against the outer face of the expanded polystyrene to form the protective skin.

The slight change in diameter of the pot 10 (at D in FIG. 3) has the effect of providing for centering of the pot 10 in the container part 26 and for holding it in that centered position. The pot flange 22 is thus spaced from the wall 40 and less likely to damage it than it would be in the event that the pot 10 is "off centre" in the lower part 26.

The rib 42 provides a means by which the outer container 24 can be lifted with safety. It is also possible to put a collar (not shown) around the lower part 26 below the rib 42, there being a carrying handle attached to the collar.

What is claimed is:

1. In combination a cooking pot which is circular in plan view and which has a lid, and a heat insulating container for receiving the pot, the container being of foamed synthetic plastics material and including an upwardly open base part having a side wall and base wall and into which said pot with its lid thereon can be lowered until it is supported by a top surface of said base wall, and a downwardly open cover part which includes a top wall and a side wall depending from the top wall, the cover part fitting onto said base part and defining therewith a cavity within which the pot is enclosed, the internal diameter of the container being greater than the external diameter of the pot whereby there is a heat insulating air gap between the pot and inner faces of said side walls.

2. The combination according to claim 1, in which said lid has a knob protruding from the top surface thereof, and the underside of said top wall has a recess therein for receiving said knob.

3. The combination according to claim 1, in which said side wall of said base part includes a surface on which said side wall of the cover part is supported whilst the container is in its closed condition, said base part further including a spigot which is radially inwardly of said support surface and which protrudes into said cover part.

4. The combination according to claim 1 and in which said top surface of said base wall has a central depression therein, said depression being encircled by a rim which supports the pot.

5. The combination according to claim 4 in which the diameter of the inner cylindrical surface of said lower part tapers and is at its smallest adjacent said rim, said pot including a change in external diameter in the region of a base thereof thereby to provide a rim which engages said inner cylindrical surface and centers the pot in said base part.

6. The combination according to claim 1, and including heat insulating means for preventing direct contact between the pot and said foamed plastics material of the container.

7. The combination of claim 6, in which said heat insulating means comprises a layer of vermiculite.

8. The combination of claim 6, in which said heat insulating means comprises a plurality of tiles.

9. The combination of claim 1, and in which the external diameter of said side wall of the base part is greatest where the base part is upwardly open, and the external diameter of said side wall of the cover part is greatest where said cover part is downwardy open, the two greater diameter parts forming an external rib which extends around the container.

10. The combination of claim 1, and including a film of synthetic plastics material shrunk onto said cover part and onto said base part so as to cover the external surfaces thereof.

* * * * *